US007404268B1

(12) United States Patent
Page

(10) Patent No.: US 7,404,268 B1
(45) Date of Patent: Jul. 29, 2008

(54) PRECISION TARGETING SYSTEM FOR FIREARMS

(75) Inventor: Edward A. Page, Kensington, MD (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 121 days.

(21) Appl. No.: 11/008,459

(22) Filed: Dec. 9, 2004

(51) Int. Cl.
*F41G 1/00* (2006.01)

(52) U.S. Cl. ..... 42/137; 42/135; 42/136; 42/126; 42/84

(58) Field of Classification Search ..... 42/135, 42/136, 137, 113, 125, 126, 139
See application file for complete search history.

(56) References Cited

U.S. PATENT DOCUMENTS

| | | | | | |
|---|---|---|---|---|---|
| 2,438,142 | A * | 3/1948 | Brower | 42/74 |
| 3,453,385 | A * | 7/1969 | Capellaro | 348/78 |
| 3,484,977 | A * | 12/1969 | Younts | 42/74 |
| 3,545,356 | A * | 12/1970 | Nielsen | 396/426 |
| 3,714,726 | A * | 2/1973 | Braun | 42/74 |
| 4,663,877 | A * | 5/1987 | Bragg | 42/74 |
| 4,955,812 | A * | 9/1990 | Hill | 434/16 |
| 4,961,278 | A * | 10/1990 | Johnson et al. | 42/122 |
| 5,026,158 | A * | 6/1991 | Golubic | 356/252 |
| 5,035,472 | A * | 7/1991 | Hansen | 359/350 |
| 5,675,112 | A * | 10/1997 | Giry et al. | 89/41.06 |
| 5,834,676 | A * | 11/1998 | Elliott | 89/41.05 |
| 6,237,462 | B1 * | 5/2001 | Hawkes et al. | 89/41.05 |
| 6,449,419 | B1 * | 9/2002 | Brough et al. | 385/136 |
| 6,871,439 | B1 * | 3/2005 | Edwards | 42/84 |
| 6,898,890 | B2 * | 5/2005 | Gaber | 42/123 |
| 2003/0154640 | A1 * | 8/2003 | Bragg | 42/74 |
| 2003/0180038 | A1 * | 9/2003 | Gordon | 396/263 |
| 2005/0268520 | A1 * | 12/2005 | Ugolini et al. | 42/126 |

* cited by examiner

*Primary Examiner*—Michael J. Carone
*Assistant Examiner*—Stewart T Knox
(74) *Attorney, Agent, or Firm*—Mark A. Wurm

(57) ABSTRACT

A precision targeting system for a firearm has an image capturing scope, a processor, and an actuator. In one embodiment, a user indicates when he wants to lock onto the target, and then readjust his aim after receiving feedback from the system. In another embodiment, the system automatically locks onto the target. After lock on, the system compares successive images, and determines if the target has moved in the firearm sight. If movement has occurred, the system calculates the degree of the movement, and sends appropriate signals to an actuator which corrects the aim of the firearm. The system thereby converts reasonably good aim into precision aim.

10 Claims, 4 Drawing Sheets

PRECISION TARGETING SYSTEM FOR FIREARMS

FIELD OF THE INVENTION

The present invention relates to precision targeting, and in particular, an intelligent processor-based precision targeting system for firearms.

BACKGROUND OF THE INVENTION

In military and law enforcement situations, marksmen and their firearms are expected to provide accurate and precise targeting at both short and long ranges. However, movements of the desired target and/or movements by the marksman may cause imprecise targeting and consequent missing of the target when the firearm is discharged.

Prior efforts to solve these problems all have their shortcomings. For example, some systems use gyroscopic technologies to combat these problems. In such systems, a gyroscope is implanted into the body or stock of a firearm. The marksman aims at the intended target, and locks the system onto the target by indicating to the system in some manner that the intended target is in the sight of the firearm. After that indication and locking onto the target, the gyroscope senses any movement in the firearm, either up and down, side to side, or a combination thereof, and through some mechanism corrects for that movement. There are at least two drawbacks to such gyroscopic systems however. First, they only correct movements of the firearm, and cannot adjust and correct for movements of the intended target. Second, since such systems are installed inside the stock or elsewhere in the firearm, they are not easy to either install or retrofit, and in most cases require at least some disassembly of the firearm.

The art is therefore in need of a precision targeting system for firearms that is effective, that is easy to install and retrofit without dismantling the firearm, and that will make corrections both for target movement and firearm movement.

SUMMARY OF EMBODIMENTS

In one embodiment, the present invention is a processor-based precision targeting module for firearms. The precision targeting module works in conjunction with an image capturing sight or scope on the firearm. The invention has an actuator system that receives signals from the processor and adjusts the aim of the firearm. A marksman first identifies an object of interest in the sight. In one embodiment, the marksman indicates to the precision targeting module that he is attempting to lock onto the target, and the module displays on the firearm sight how accurate the marksman is. After any necessary adjustments by the marksman, the marksman again indicates to the system that he would like to lock onto the target. In another embodiment, the marksman sets his firearm sight onto the object of interest, and the image processing of the system automatically locks onto the object. In either embodiment, after the system locks onto the object of interest, the sight captures the image and stores it in memory.

After the object of interest has been locked onto, the system captures further images, and compares these images to the most recent image stored in memory to determine if the object of interest has moved in the sight, indicating that either the object of interest has moved or that the firearm has moved. If movement has occurred, the system sends signals to an actuator system that moves the stock of the firearm in the proper direction to correct the aim which results in a re-positioned image of the object of interest in the sight. As the stock of the firearm moves, the firearm pivots on the non-trigger hand of the marksman, and the barrel of the firearm moves rotationally, thereby altering the aim of the firearm.

It is therefore an object of one or more embodiments of the present invention to provide a precision targeting system for a firearm that automatically and continuously corrects for target movement and/or movement of the firearm.

DETAILED DESCRIPTION OF EMBODIMENTS

One or more embodiments of the present invention relate to precision targeting systems that can be easily attached to firearms, especially long barreled firearms such as rifles, and more particularly, military long barreled firearms such as the M4 or M16.

Figure 1:
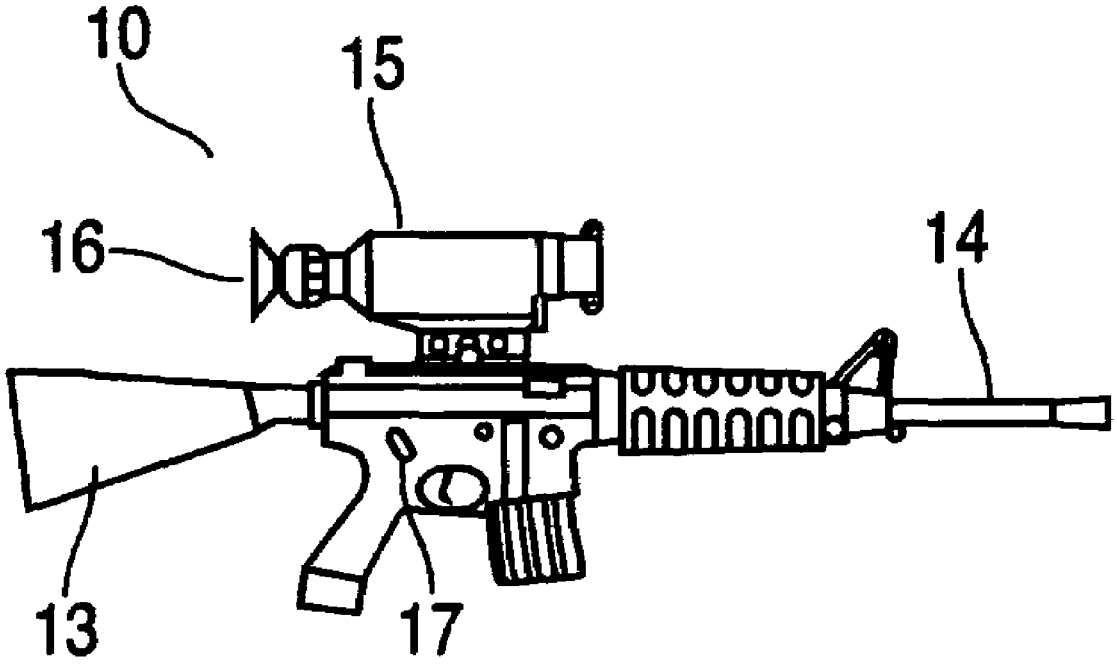
FIG. 1 illustrates a firearm on which an embodiment of a precision targeting system of the present invention may be installed.

The precision targeting system of the present invention corrects the aim of a firearm. The precision targeting system identifies this need for correction by sensing movement of the intended target within the field of view of the scope of the firearm. This movement could be the result of the movement of the intended target itself, or the movement of the firearm. An embodiment of the precision targeting system of the present invention has three main components—an image capturing sight or scope, a processor, and an actuator. FIG. 1 illustrates a firearm 10 upon which the precision targeting system of the present invention may be installed. Firearm 10 has stock 13, barrel 14, image capturing sight 15, eye cap 16, and button or switch 17. A precision targeting system is placed onto the end of the stock 13, and a cover plate is placed onto the precision targeting module. In another embodiment, the stock of the firearm may be cut off at the end, the precision targeting module installed on the end of the stock, and the portion that was cut off placed onto the precision targeting module to serve as a cover plate.

There are several technologies that can be used for the image capturing sight. Some of the technologies are currently used in connection with firearms, especially in the military, while others have been used in other image processing applications, but would work quite well in a firearm environment. One technology that is currently used rather extensively on military firearms is the thermal (IR) imaging sight. Visual technologies that could work equally well are the COTS based CCD and CMOS technologies. Whether thermal, visual, or some other technology is used, the sight should be set up to allow for the overlaying of images such as a reticle, the object of interest (designated target), and status messages.

The image capturing sight 15 is connected to a processor. The processor can be an off the shelf general purpose programmable microprocessor. The functions of the processor include receiving and storing frames of image data, comparing image frames including analysis within the frame, determining whether a correction needs to be made in the aim of the firearm, and sending appropriate signals to the actuator which will correct the aim of the firearm. The processor is connected to a button or switch 17. The button or switch 17, which in a preferred embodiment is positioned on the firearm such that the marksman can press it with one of the fingers on his trigger hand, allows the marksman to send signals to the processor.

Figure 2:
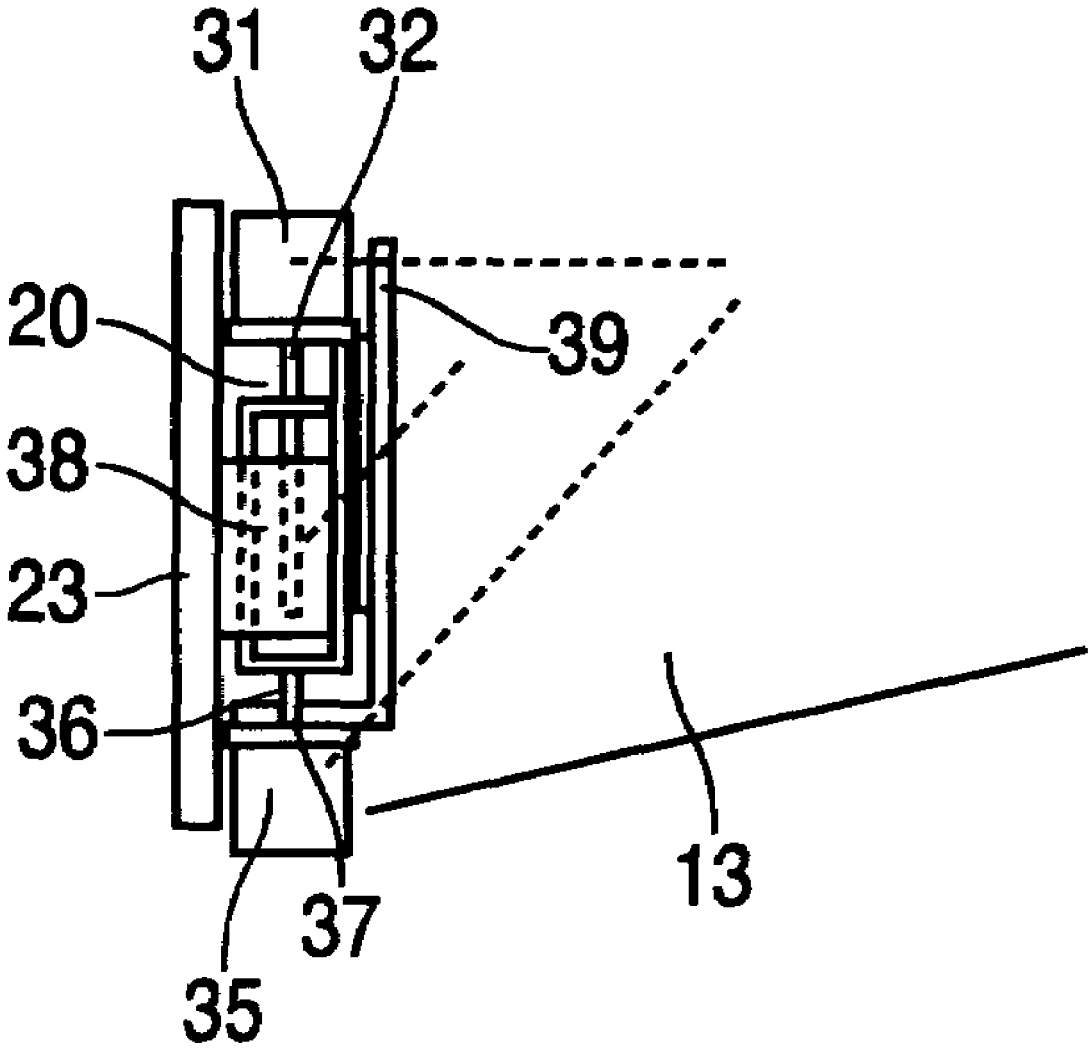
FIG. 2 illustrates a side view of an embodiment of an actuator that can be used in connection with the present invention.

The processor is also connected to an actuator, which is part of a precision targeting module 20. An embodiment of a precision targeting module 20 and an actuator that can be used in connection with the present invention is illustrated in FIG. 2. The actuator has motors 31 and 35, which are connected to shafts 32 and 36 respectively. Shaft 32 is connected to direction shifter 38, and one side of direction shifter 38 is fixed to cover plate 23. Motors 31 and 35, and direction shifter 38, are connected to the stock end of the firearm via plates 37 and 39.

Figure 3:
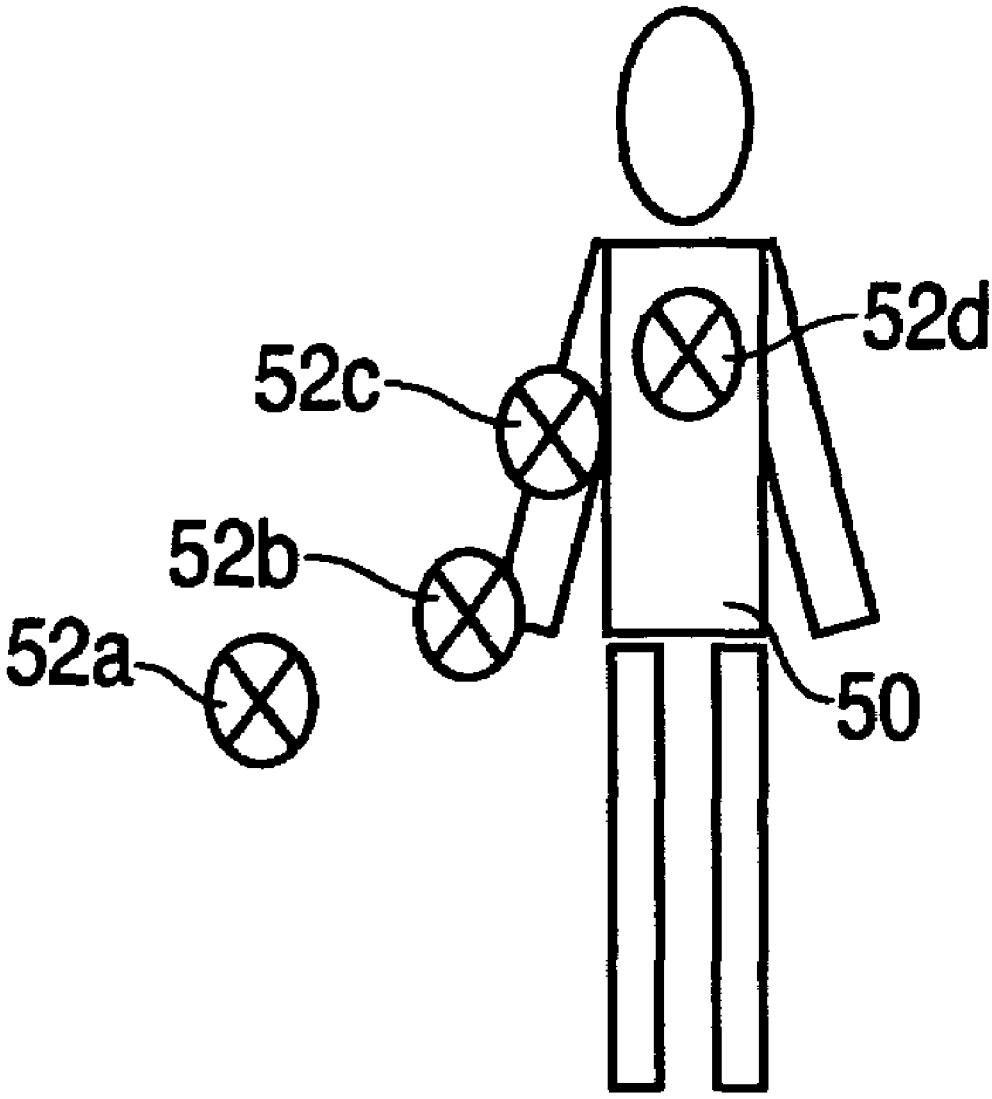
FIG. 3 illustrates in diagrammatic form the manner in which an embodiment of the present invention works in semi-automated mode.

One or more embodiments of the precision targeting system of the present invention can operate in at least two modes—automated and semi-automated. FIG. 3 illustrates the close-up of a human target display of the image capturing sight 15 as may be seen in the semi-automated mode. The sight 15 displays an object of interest 50, e.g. an enemy combatant. The marksman positions his firearm so that the object of interest is substantially centered in the sight. At that point, the marksman presses button 17. This sends a signal to the processor, and the processor indicates exactly where the firearm is aimed in the field of vision by displaying an X (or some other marking) at that point. (FIG. 3; Nos. 52*a*, 52*b*, 52*c*). The marksman, then seeing on the scope the spatial relationship between the X marking and the object of interest, repositions his firearm, and presses button 17 again. (e.g., 52*b*). This process is repeated until the firearm is correctly aimed at the object of interest. (i.e., 52*d*) This is determined by the marksman when the X marking is placed on the object of interest in the desired location. The marksman then designates that his firearm is appropriately aimed. One way that the marksman could make this designation would be to move the gun through the target to signal the designation to the processor. Alternatively, the marksman could press button 17 twice in succession, and the processor would recognize that as a designation of, rather than a searching for, the intended target.

After the marksman designates that the firearm is correctly aimed (also referred to as locking onto the target), he attempts to remain still and not move the firearm. However, this is not always humanly possible, so the precision targeting system automatically adjusts the aim of the firearm to compensate for any unintended movement of the firearm by the marksman. The precision targeting system will also correct the aim of the firearm due to movement of the designated target. It is noteworthy that the adjustments made by the system are relatively small, such as a single degree or two to one side or the other. Such small adjustments however, when translated out to an object that is 100 meters or more away, amount to a meter or more at the point of the target. Additionally, the small adjustments made by the invention are virtually imperceptible to the marksman, so the marksman will then not have a tendency to fight the automatic adjustments. After the marksman locks onto the target, the precision targeting module 20 monitors the aim of the firearm, and makes continuous small corrections so that the firearm maintains its sight at the desired point on the object of interest.

The processor monitors the aim of the firearm by continuously capturing and storing frames of video data from the image capturing sight 15. After capturing an image frame, the processor uses bit map processing to identify the outline of the object of interest by determining where the pixels that make up the object of interest terminate, and where pixels representing another object or the background in the frame begin. One way the processor can do this is by starting at the origin of the stored frame (0,0), and then examining the pixels in all directions searching for a change in pixel intensity, thereby signaling an edge of the object of interest. After determining the outline of the object of interest, the processor stores in memory the bit map locations of the sight display that outline the edges of the object of interest. Thereafter, the processor receives from the image capturing scope the next image frame and stores that next image frame in another memory location. The processor then compares the two image frames to see if the object of interest has moved in the sight display. First, the processor knows that the object of interest has not moved if there is a high correlation from a comparison of the data pixels between the two image frames. However, if there is not a good correlation between the pixels of the two image frames, this indicates that the object of interest has moved in the display sight, which indicates that either the firearm has moved or that the object of interest has moved. If movement has occurred, the processor determines the direction that the object of interest has shifted. One embodiment of the invention determines this direction by examining the outside edges of the object of interest on the most recently captured image. Specifically, the pixels in the area of the image edges are examined in order to find the intensities that outline the edges of the image. When the outline of the newly captured image is determined, the pixel positions of the newly captured image are compared to those of the prior image, and the extent of the movement of the object of interest in the sight display is then easily calculable. While this algorithm works quite well, persons of skill in the art will realize that other bit map processing technologies and algorithms including edge detection bit mapping will also work. Irrespective of the bit map process that is used, the process is continued until a good fit is found, indicating the new position of the object of interest in the sight.

In one embodiment, if the processor determines that the object of interest has not moved in the firearm's sight, which would be the case if neither the object of interest itself has moved nor the firearm has moved, the processor does not send a signal to the actuator. However, if the processor determines that movement has occurred, the processor signals the actuator to move which automatically re-centers the object of interest at the origin of the image sight (0,0), and sends a signal to the actuator to move the actuators in the appropriate direction so that the aim of the firearm correlates with the re-centered object of interest.

In the simplest case, the processor determines that there has been movement in the up, down, left or right directions. For example, if the processor determines that the intended target has moved up in the firearm's sight, a signal is sent to the motor 35 so that the shaft 36 rotates and moves plates 37 and 39 along a guide (not visible in FIG. 2) in the up or down direction. This also causes motor 31 and direction shifter 38 to move in the up or down direction. Since the plate 39 is fixed to the stock 13 at the end, the stock 13 of the firearm moves up or down. And further since the direction shifter 38 is fixed to cover plate 23, and cover plate 23 is held tightly against the shoulder by the marksman, the barrel 14 moves up or down since the firearm will pivot on the non-trigger hand of the marksman.

Figure 4:
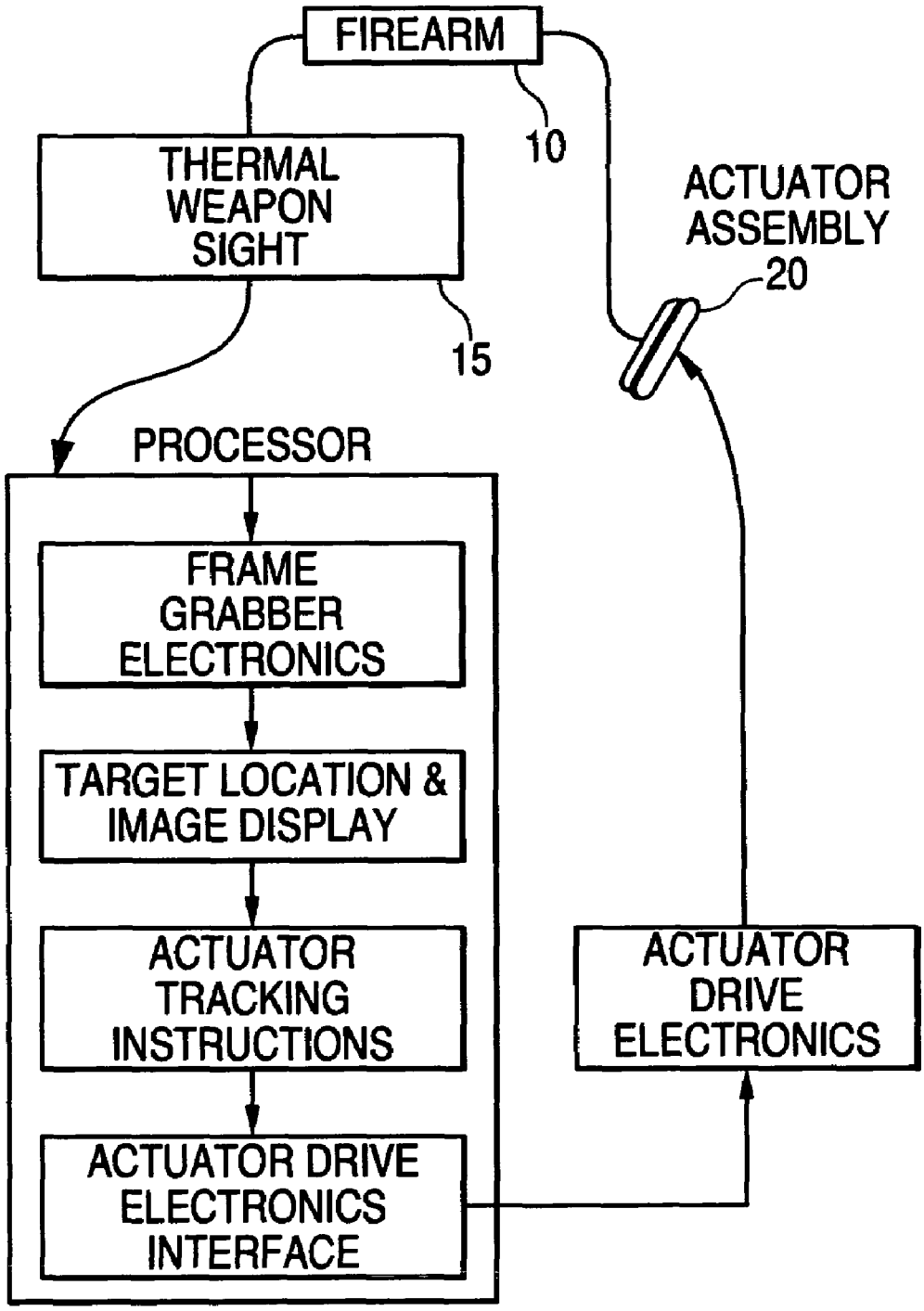
FIG. 4 illustrates a process flow diagram for an embodiment of a precision targeting system of the present invention.

If the processor determines that the object of interest has moved either to the left or to the right in the sight display 15, a signal is sent to motor 31 to rotate shaft 32. Shaft 32 rotates through direction shifter 38. In one embodiment, direction shifter 38 can be thought of as a block that is divided into two pieces by a diagonal bisection. The rotation of the shaft 32 causes the two diagonal halves of direction shifter 38 to slide against each other. Since one diagonal half of direction shifter 38 is attached to the cover plate, and the other half is connected to plate 39, this causes plate 39 to move right or left along a guide (not visible in FIG. 2). When the two halves of the direction shifter slide farther apart from each other, the stock end of the firearm will move one way (e.g to the right), and when the two diagonal halves slide back together, stock end of the firearm moves in the other direction. As with the up and down movements of the stock end, the barrel 14 of the firearm will move to the left (when the stock end moves right), or to the right (when the stock end moves left), as the firearm pivots on the rion-trigger hand of the marksman. One of skill in the art will realize that up and down shifts can be combined with lateral shifts to readjust the aim of the rifle in any direction. Moreover, persons of skill in the art will realize that other configurations could be used for the actuator to move the stock of the firearm in the appropriate directions. The process flow of the precision targeting system of the invention is illustrated in FIG. 4.

In the automatic embodiment of the precision targeting system of the present invention, the marksman does not indicate to the processor when he is trying to lock onto the object of interest. Rather, through image and bit map processing technology, the processor recognizes a target of interest and finds an aim point, and after that recognition, maintains the sight of the firearm on that target aim point. Specifically, in one embodiment, the processor searches for an object of interest in the center of the image display (for that is where the marksman will naturally sight an object of interest). By identifying the outer perimeter of the object of interest, through an examination of the values associated with the pixels, the shape of the object can be mapped and stored. In subsequent data image frames, as in the above described semi-automated embodiment, the processor compares successive data frames, and determines if the object of interest has moved in the image display. If the processor determines that the object of interest has moved, the processor sends the appropriate signals to the motors to move the motors and direction shifter 38 to readjust the aim.

In the just described embodiments, a mechanical actuator moves the stock of the firearm relative to a cover plate which stays positioned stationary against the shoulder of a marksman. In another embodiment, the distance between the cover plate 23 and the stock 13 of a firearm is either increased or decreased in a certain area of the stock 13, causing the rifle and its barrel to move and re-direct its aim. For example, if the aim needed to be re-directed upward, a mechanism would be used to increase the distance between the bottom of the stock 13 and the cover plate 23, thereby causing the firearm to pivot on the non-trigger hand of the marksman and raise the barrel of the rifle. Increasing the distance between the proper section of the cover plate 23 and stock 13 could be done for example with inflatable sacs that are filled with a gas (such as $CO_2$) and expanded to increase the distance between the cover plate and the stock.

Similarly, in another embodiment, the cover plate 23 and stock 13 could have threaded holes therein, which are connected by a threaded shaft. To increase or decrease the distance between the cover plate and the stock, a motor or other means rotates a shaft in the clockwise or counter-clockwise direction, thereby increasing or decreasing the distance between the cover plate and the stock in that area of the shaft and threaded holes. As described above, this then re-positions the barrel and the aim of the firearm.

In one or more embodiments, the eye cap 16 functions as a switch to turn the power on and off to the precision targeting module 20. This will insure that power is only supplied to the precision targeting module when it is needed, i.e. when the marksman is taking aim at an object of interest. With such a setup, the batteries that power the precision targeting unit, e.g. three C cell lithium batteries in one embodiment, will provide 30 hours or more of run time operation.

While the invention has been described in its preferred and other embodiments, it is to be understood that the words used are words of description rather than limitation and that changes may be made within the purview of the appended claims without departing from the true scope and spirit of the invention in its broader aspects.

The invention claimed is:

1. A precision targeting module for a firearm comprising:
- an image capturing sight;
- a processor electrically coupled to said image capturing sight; and
- an actuator connected to the stock or said firearm, said actuator further electrically coupled to said processor, wherein said actuator comprises:
  - a first motor;
  - a second motor; and
  - a direction shifter, said direction shifter connected to said first motor by a first shaft, wherein said direction shifter comprises:
- a first triangular portion having a first hypotenuse; and
- a second triangular portion having a second hypotenuse, said first hypotenuse and said second hypotenuse in proximity to each other;
- said first triangular portion and said second triangular portion forming a dimension of said direction shifter; and
- wherein said first hypotenuse and said second hypotenuse move with respect to each other, thereby changing said dimension of said direction shifter.

2. The precision targeting module according to claim 1, wherein said actuator causes said stock to move in a first direction, and said actuator causes said stock to move in a second direction, wherein said second direction is substantially perpendicular to said first direction.

3. The precision targeting module for a firearm according to claim 1, further comprising a cover plate attached to said actuator.

4. The precision targeting module for a firearm according to claim 1, wherein a portion of said stock is removed and said actuator is placed onto said stock.

5. The precision targeting module for a firearm according to claim 1, further comprising a buttnn or switch coupled to suid processor for sending signals to said processor.

6. The precision targeting module for a firearm according to claim 1, further comprising an eye cap attached to said image capturing sight, said eye cap further connected to a power supply for said precision targeting module.

7. The precision targeting module for a firearm according to claim 1, wherein said image capturing sight is an infrared sight.

8. The precision targeting module according to claim 1, wherein said imago capturing sight is a CCD or a CMOS.

9. A precision targeting module for a firearm, said firearm comprising a stock and a cover plate connected to an end of said stock, said module comprising:
- an image capturing sight;
- a processor electrically connected to said image capturing sight; and
- means to move said stock of said firearm so as to increase or decrease the distance between said stock and said cover plate, and said means to move said stock of said firearm is electrically coupled to said processor, wherein said means to move said stock of said firearm comprises:

one or more threaded holes in said cover plate;

one or more threaded holes in said stock;

one or more threaded rods connecting said threaded holes in said cover plate and said threaded holes in said stock; and a motor to rotate said one or more threaded rods to increase or decrease the distance between said cover plate and said stock.

10. The precision targeting module for a firearm according to claim 9, wherein said means to move said stock of said firearm comprises one or more inflatable sacks positioned between said stock of said firearm and said cover plate.

* * * * *